United States Patent [19]

Zoleski et al.

[11] 4,414,123

[45] Nov. 8, 1983

[54] MARINE DIESEL CYLINDER OILS CONTAINING POLYOXYETHYLENE SORBITOL LANOLIN FOR IMPROVED SPREADABILITY

[75] Inventors: Benjamin H. Zoleski, Beacon; Rodney L. Sung, Fishkill, both of N.Y.

[73] Assignee: Texaco Inc., White Plains, N.Y.

[21] Appl. No.: 268,955

[22] Filed: Jun. 1, 1981

[51] Int. Cl.[3] ..... C10M 1/20

[52] U.S. Cl. ..... 252/52 A; 252/33.4

[58] Field of Search ..... 252/52 R, 52 A, 56 R, 252/33.4

[56] References Cited

U.S. PATENT DOCUMENTS

| | | | |
|---|---|---|---|
| 2,493,483 | 1/1950 | Francis et al. | 252/33.4 |
| 3,087,897 | 4/1963 | Stedt et al. | 252/56 R X |
| 3,390,083 | 6/1968 | Lion | 252/56 R X |
| 4,035,514 | 7/1977 | Davis | 252/52 A X |
| 4,066,789 | 1/1978 | Mores et al. | 252/56 R X |

OTHER PUBLICATIONS

Hori et al., "Spreadability of Marine Diesel Engine Cylinder Oils on a Glass Surface at High Temperatures", 2/77, Lub. Eng., p. 83–90.

Atlas Brochure, "Properties of Atlas Surfactants".

*Primary Examiner*—Andrew Metz

*Attorney, Agent, or Firm*—Carl G. Ries; Robert A. Kulason; Henry W. Archer

[57] ABSTRACT

The spreadability of marine diesel cylinder oils is improved by the incorporation therein of a polyoxyethylene sorbitol lanolin of the formula:

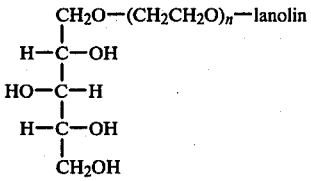

/ wherein n ranges from 14 to 16.

10 Claims, No Drawings

MARINE DIESEL CYLINDER OILS CONTAINING POLYOXYETHYLENE SORBITOL LANOLIN FOR IMPROVED SPREADABILITY

BACKGROUND OF THE INVENTION

1. Field of the Invention

This invention relates generally to a marine diesel cylinder oil containing a special nonionic detergent to improve its spreadability characteristics. The invention relates also to a process for lubricating marine diesel engine cylinders.

As is well known, the main purpose of a lubricant is to provide a fluid film between moving metal surfaces to prevent metal-to-metal contact. Any portion of the metal surface not covered by the lubricant is a potential site for severe wear, scuffing and corrosion to take place. Premature wear, scuffing or corrosion will necessitate the replacement of parts sooner than normal, resulting in increased maintenance costs. Furthermore, any wear debris can cause damage in other parts of the engine.

In marine diesel engines, particularly the cross-headed type, which uses a separate oil system to lubricate the upper cylinder chamber (piston, rings and cylinder liners) where combustion occurs, the ability of the lubricant to cover all metal surfaces adequately and quickly is of paramount importance. The ability of a lubricant to cover a metal surface is known as its "spreadability" characteristic, which also measures its effectiveness in use.

The method used to lubricate the upper cylinder area of a cross-headed marine diesel engine consists of injecting the lubricant into the cylinder through a series of orifices (quills) that are located around the upper circumference of the cylinder. As the lubricant is injected it runs down and across the cylinder liner providing a film over the surface that should prevent metal-to-metal contact between the cylinder liner, piston rings and piston skirt as the piston travels in the combustion chamber.

The problem addressed by the present invention is based on the observation that in many instances the lubricant does not cover the entire cylinder liner surface, leaving dry spots that are potential wear sites. Usually, the area directly under the quills is covered with an oil film but the area adjacent to the quills is dry because of the oil's poor spreadability.

One method of improving the spreadability of oil over the cylinder liner would be to redesign the injector/quill system. This approach would not only be impractical but would be economically prohibitive. Another means of improving spreadability would be to use a lower viscosity lubricant. However, since marine engines are designed to use SAE 50 grade cylinder oils for proper film strength, a lower viscosity product would not support the stresses occurring in this area of the engine and film breakage might be greater than desired, leaving additional areas of unprotected metal.

Another factor to consider is the increased use of high sulfur oils requiring the spreadability of lubricants to be such that they can be readily dispersed on diesel cylinder surfaces to neutralize acidic combustion products, thus preventing costly cylinder and piston ring corrosion and damage.

2. Description of the Prior Art

The relevant prior art is directed mainly to compositions useful in two-cycle gasoline engines and not to spreadability in two-cycle marine diesels. This art includes Belgian Pat. No. 792960 which uses a polyalkylene glycol of the formula $HO(RO)_nH$ where R is a divalent aliphatic radical and n is 2 to 50. Japanese Patent S 4160401 suggests adding a polyoxyethylene glycol monoalkylether to a two-stroke engine oil to decrease the amount of soot in the exhaust.

Certain properties of the additives used herein are tabulated in the brochure, "General Characteristics of Atlas Surfactants," ICI United States Inc., 1977.

SUMMARY OF THE INVENTION

The invention provides a process for improving the spreadability of a marine diesel engine cylinder oil by incorporating therein at least 0.5 weight percent thereof of at least one of the above polyoxyethylene sorbitol lanolins.

The invention additionally provides a process for lubricating the moving metal surfaces of a marine diesel engine cylinder by preventing their metal-to-metal contact with a film of the improved oils of the present invention.

DISCLOSURE

The oils with which this invention is concerned are generally of the SAE 50 grade cylinder oil type having a total base number (TBN) ranging from about 50 to about 100.

The preferred additives for use in this invention are sold commercially under the trademarked name Atlas G 1441 and G 1471 by Atlas, ICI Americas, Wilmington, Del. 19897.

The additives of the invention have the formula:

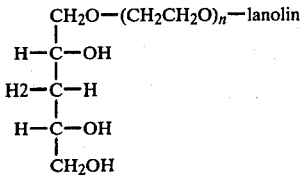

wherein n is 14 to 16.

As defined in Noller's "Chemistry of Organic Compounds," Wool grease is a complex mixture of waxes, alcohols, and free fatty acids recovered from scouring of wool. Some of the acids obtained by the hydrolysis of the waxes are unusual in that they have methyl branches and contain both odd and even numbers of carbon atoms from $C_9$ to $C_{27}$. Wool grease has the unusual property of forming a stable semisolid emulsion containing up to 80% water. A purified product is knows as lanolin.

A particularly preferred additive is Atlas G 1441 wherein n in the above formula is 14.

SPREADABILITY TEST METHOD

The compositions of this invention were tested by measuring the diameter (mm.) of a drop of oil after a predetermined time that the drop had been placed on a heated plate. As the drop diameter increases, the spreadability of the lubricant is improved. This procedure gives results which may be reasonably correlated with the true performance of engine oils in the cylinder lubrication of cross-head type marine diesel engines.

The apparatus used in this method includes heating means such so that the temperature of a test panel can be controlled at 250±5° C. (unless otherwise specified). The panel coker specified in Federal Test Method Standard No. 791a, Method 3462 can be used. Also required are a microsyringe of 10±0.5 microliter capacity, needle exchangeable type, and calipers. The materials and reagents used are as follows: A test panel of gray iron castings conforming to JIS G 5501, Class FC-20, or ASTM A 48, Class No. 30; 50 by 50 by 5 1 mm. pierced with two holes, one of 2 mm. in diameter and 25 mm. in depth at the center of thin surface to insert a thermocouple, and another of 1 mm. in diameter at an edge for suspension in washing liquid; water abrasive papers (silicon carbide, 400, 600 and 800 grit); petroleum ether having a distillation range of 30°–80° C. or an equivalent refined naphtha, benzene and methyl alcohol.

In brief, the apparatus is prepared for use as follows: One surface of the test panel is polished by pushing and moving around it a 400 grit abrasive paper placed on a flat surface. It is subsequently polished the same way with 600 and 800 grit abrasive papers. Each polishing stage is continued until the disappearance of coarse scratches made in the preceding polishing stage. The test panel is washed after first removing dust using a gauze wet with petroleum ether. A wire is fastened to the hole at the edge of the test panel and same is suspended and dipped first into a beaker of hot benzene then in one of hot methyl alcohol, both boiling on a hot water bath, for one to two minutes respectively. After removing the test panel, it is immediately dried with hot air.

The microsyringe is washed several times with petroleum ether after detaching its needle. The plunger is then removed and the inside surface of the syringe is dried. It is washed twice with the sample to be tested, detaching the needle on intake and replacing it on discharging.

In performing the test, the test panel is placed on the heating block of the heating apparatus which is kept horizontal. Care must be exercised not to touch the surface of the test panel during the test. Next, the test sample is drawn slowly into the syringe to avoid the formation of an air bubble. The microsyringe is set vertically above the polished and washed surface of the test panel with a clearance of about 1 mm. In about 5 minutes, the test panel is heated to 250° C. While maintaining the temperature of the test panel at 250±5° C. (or at any other desired temperature), 10 microliters of sample are dropped on the panel. One minute after dropping, the diameter of the sample film is measured and recorded to the nearest 1 mm. If the sample film is elliptical, the longest diameter is measured; if the film juts out irregularly, the jutted out portion is not measured. When the sample film turns out to be too irregular, the determination is rejected and the procedure is repeated. Two separate determinations are conducted for each sample. If their individual values differ from more than 10 percent of their means, two other determinations are carried out.

The values for two separate determinations are averaged to the nearest 1 mm. and the average is reported as the spreadability.

EXAMPLES

The invention is further illustrated in non-limiting fashion by the following example.

The example involved blending at ambient temperature a polyoxyethylene sorbitol lanolin in an SAE 50 diesel engine cylinder lubricant. As determined by the test above described, this lubricant had a spreadability value of 14.1 mm. and contains both paraffinic and naphthenic base stocks.

Considering Table I below, as shown by Blend 1, adding 2% of a polyoxyethylene sorbitol lanolin having 14 ethoxy groups to a blended oil increases the drop diameter to 26.2 mm. for an improvement of 89 percent.

TABLE I

| Blended Oil | SAE 50 Control | 1 |
|---|---|---|
| Composition, Wt. % | | |
| Base Oil 30 | 40.00 | — |
| Base Oil 50 | 30.20 | — |
| Alkaline Detergent[1] | 8.80 | — |
| Alkaline Detergent[2] | 17.00 | — |
| Alkaline Dispersant[3] | 3.10 | — |
| Control | | 98 |
| Polyoxyethylene (20) Sorbitol Lanolin | | 2 |
| Spreadability (mm.) | 14.1 | 26.2 |

[1]Calcium carbonate overbased (400 TBN) calcium sulfonate
[2]Sulfurized $CO_2$ blown, double neutralized normal calcium alkylphenolate
[3]Mixed alkenylsuccinimides

What is claimed is:

1. A process for improving the spreadability of a diesel engine cylinder lubricant having a total base number ranging from about 50 to 100 owing to the presence therein of alkaline detergents which comprises blending with said lubricant a spreadability improving amount of at least 0.5 weight percent thereof of at least one polyoxyethylene sorbitol lanolin of the formula:

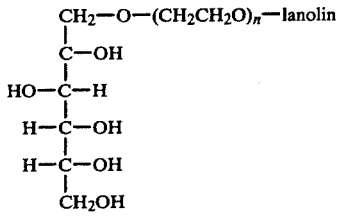

wherein n is an integer ranging from 14 to 16.

2. The process of claim 1 wherein said lanolin has n equal to 14.

3. In a diesel engine cylinder lubricant comprising a major amount of an oil having an SAE viscosity of about 50 and a total base number ranging from about 50 to about 100 due to the presence of alkaline detergents, the improvement comprising in the presence therein of at least 0.5 weight percent thereof of a spreadability improving amount of at least one nonionic detergent polyoxyethylene sorbitol lanolin of the formula:

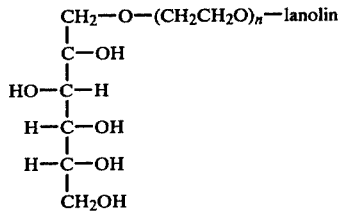

wherein n is an integer ranging from 14 to 16.

4. The lubricant of claim 3 wherein said lanolin has n equal to 14.

5. A process for lubricating the moving metal surfaces of a marine diesel engine cylinder which comprises causing a film of a diesel oil having a total base number ranging from about 50 to about 100 due to the presence therein of alkaline detergents to spread on said surfaces by incorporating in said diesel oil a spreadability improving amount of at least one nonionic detergent polyoxyethylene sorbitol lanolin of the formula:

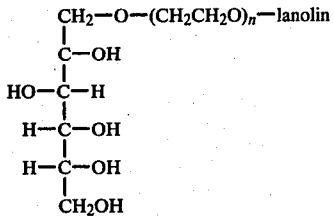

wherein n ranges from 14 to 16.

6. The process of claim 5, wherein said lanolin has n equal to 14.

7. The process of claim 1 wherein 2 percent by weight of said lanolin is blended.

8. The lubricant of claim 3, containing 2 percent of said lanolin.

9. The process of claim 5, wherein at least 0.5 of said lanolin is incorporated.

10. The process of claim 5, wherein 2 percent by weight of said lanolin is incorporated.

* * * * *

UNITED STATES PATENT AND TRADEMARK OFFICE

CERTIFICATE OF CORRECTION

PATENT NO. : 4,414,123

DATED : Nov. 8, 1983

INVENTOR(S) : Benjamin H. Zoleski, Rodney L. Sung

It is certified that error appears in the above—identified patent and that said Letters Patent is hereby corrected as shown below:

In the Abstract, the portion of the formula reading:

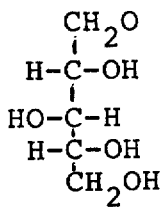

Should read

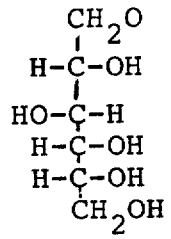

In column 2, line 36 through 44 that portion of the formula reading:

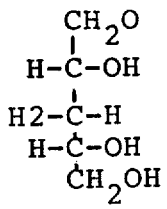

Should read

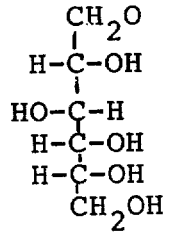

UNITED STATES PATENT AND TRADEMARK OFFICE

CERTIFICATE OF CORRECTION

PATENT NO. : 4,414,123 Page 2 of 2

DATED : Nov. 8, 1983

INVENTOR(S) : Benjamin H. Zoleski, Rodney L. Sung

It is certified that error appears in the above—identified patent and that said Letters Patent is hereby corrected as shown below:

In Claims 1, 3, and 5 that portion of the formula reading:

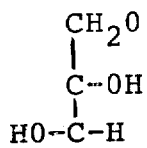

Should read

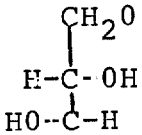

Signed and Sealed this

Seventeenth Day of July 1984

[SEAL]

Attest:

GERALD J. MOSSINGHOFF

Attesting Officer

Commissioner of Patents and Trademarks